US010362860B2

(12) United States Patent
Lee

(10) Patent No.: US 10,362,860 B2
(45) Date of Patent: Jul. 30, 2019

(54) FLAT PACK END TABLE AND COFFEE TABLE

(71) Applicant: Zinus Inc., San Leandro, CA (US)

(72) Inventor: Youn Jae Lee, Pleasanton, CA (US)

(73) Assignee: Zinus Inc., Tracy, CA (US)

( * ) Notice: Subject to any disclaimer, the term of this patent is extended or adjusted under 35 U.S.C. 154(b) by 250 days.

(21) Appl. No.: 15/381,053

(22) Filed: Dec. 15, 2016

(65) Prior Publication Data

US 2017/0164730 A1 Jun. 15, 2017
US 2018/0160798 A9 Jun. 14, 2018

(30) Foreign Application Priority Data

Dec. 15, 2015 (CN) ..... 2015 3 0532147
Dec. 15, 2015 (CN) ..... 2015 3 0532149
Dec. 15, 2015 (CN) ..... 2015 3 0532179
Dec. 15, 2015 (CN) ..... 2015 3 0532214
Dec. 28, 2015 (CN) ..... 2015 2 1107285 U
Dec. 28, 2015 (CN) ..... 2015 2 1107519 U
Jan. 22, 2016 (CN) ..... 2016 2 0064361 U
Jan. 22, 2016 (CN) ..... 2016 2 0064396 U

(51) Int. Cl.

| | |
|---|---|
| ***A47B 3/12*** | (2006.01) |
| ***B65D 5/42*** | (2006.01) |
| ***A47B 13/02*** | (2006.01) |
| ***A47B 37/00*** | (2006.01) |
| ***A47B 13/08*** | (2006.01) |

(52) U.S. Cl.
CPC ..... *A47B 3/12* (2013.01); *A47B 13/02* (2013.01); *A47B 37/00* (2013.01); *B65D 5/4266* (2013.01); *A47B 13/08* (2013.01)

(58) Field of Classification Search
CPC ..... A47B 3/00; A47B 3/12; A47B 13/02
See application file for complete search history.

(56) References Cited

U.S. PATENT DOCUMENTS 5,540,158 A * 7/1996 Ford ..... A47B 3/08 108/115
5,794,546 A * 8/1998 Carter ..... A47B 3/12 108/115
2003/0205180 A1* 11/2003 Bishop ..... A47B 3/06 108/158.12
2006/0021550 A1* 2/2006 Sagol ..... A47B 3/02 108/115

(Continued)

*Primary Examiner* — Daniel J Rohrhoff
(74) *Attorney, Agent, or Firm* — Imperium Patent Works; Darien K. Wallace

(57) ABSTRACT

A flat pack table comprises a first straight bar, a second straight bar, a first U-shaped bar, a second U-shaped bar, and a rectangular table top. The flat pack table is arrangeable into a compact state in which the first U-shaped bar and second U-shaped bar are nested around the table top and the straight bars. The straight bars, the U-shaped bars, and the table top have an identical width. In the compact state, the table is insertable into a packing box having an inner width no greater than the width of the table components. The flat pack table takes up a packing area within the box that is over ninety percent of the total packing area of the box. After removing the table from the box, the table is assemblable into an end table. Compact packing of the table provides for optimal storing, shipping, and transporting of the table.

12 Claims, 14 Drawing Sheets

(56) References Cited

U.S. PATENT DOCUMENTS

| | | | | |
|---|---|---|---|---|
| 2010/0147200 | A1* | 6/2010 | Polidoros | A47B 3/12 108/157.16 |
| 2016/0174700 | A1* | 6/2016 | Brandenberg | A47B 47/04 5/93.1 |
| 2017/0188697 | A1* | 7/2017 | Lin | A47B 3/02 |

* cited by examiner

TOP VIEW OF FLAT PACK TABLE COMPONENTS

SIDE VIEW OF FLAT PACK
TABLE COMPONENTS

TOP VIEW OF PACKAGE

COMPACT PACKING OF FLAT PACK TABLE COMPONENTS

COMPACT PACKING OF FLAT PACK TABLE COMPONENTS

FLAT PACK TABLE WITH SHELF

FLAT PACK END TABLE AND COFFEE TABLE

CROSS REFERENCE TO RELATED APPLICATIONS

This application is a continuation-in-part of, and claims priority under 35 U.S.C. § 119 from the following Chinese patent applications: design patent application no. 201530532149.X filed on Dec. 15, 2015, utility model application no. 201521107285.5 filed on Dec. 28, 2015, design patent application no. 201530532147.0 filed on Dec. 15, 2015, utility model application no. 201521107519.6 filed on Dec. 28, 2015, design patent application no. 201530532214.9 filed on Dec. 15, 2015, utility model application no. 201620064361.7 filed on Jan. 22, 2016, design patent application no. 201530532179.0 filed on Dec. 15, 2015 and utility model application no. 201650064396.0 filed on Jan. 22, 2016. The entire subject matter of the aforementioned patent documents is incorporated herein by reference.

TECHNICAL FIELD

The present invention relates to furniture products, and in particular to packaged tables.

BACKGROUND INFORMATION

Conventional table furniture generally includes four legs or support structures that support a base platform. The legs are often attached directly to the base platform. Other types of conventional table furniture are packaged in a conventional box and assembled by a retail customer. For example, the retail customer purchases the packaged table, removes the legs and the base platform from the box package, and screws the legs to the base platform.

A conventional packaged table is typically large and bulky, having the same length and width dimensions as the base platform. A conventional packaged table, due to the dimensions of the base platform, is often difficult to handle by a single retail customer. The dimensions of a conventional packaged table make it impractical for a consumer to transport the packaged table from a mass-market retail store. For example, the typical packaged table does not fit in the trunk of a car. Moving such a packaged table into apartment elevators and around corners into living rooms is often difficult and exposes the table components and doorways to potential damage. In addition, the dimensions of a packaged table take up valuable floor space which discourages mass-market stores from offering table furniture to their retail customers. A packaged table that overcomes these challenges is desired.

SUMMARY

A flat pack table comprises a first straight bar, a second straight bar, a first U-shaped bar, a second U-shaped bar, and a rectangular table top. The straight bars, the U-shaped bars, and the table top have an identical width "A". The first and second straight bars have a length "B". A distance "C" between ends of the U-shaped bars equals width "A" plus length "B". The table top is a rectangle having a shorter length "B" and longer length "D". The table top is also referred to as a base. The flat pack table is arrangeable into a compact state for efficient storing and transporting, and is assemblable into an assembled state to form an end table.

In the compact state, the first U-shaped bar and second U-shaped bar are nested around the table top and the straight bars. The table top and straight bars fit in the nest area that is formed by the U-shaped bars in the compact state. When in the compact state, a first and second side of the table top are adjacent to two surfaces of one of the U-shaped bars, a third side of the table top is adjacent to a single surface of the other of the U-shaped bars, and a fourth side of the table top is adjacent to a single surface of one of the straight bars. Ends of first U-shaped bar extend in a first direction away from straight bars. Ends of the second U-shaped bar extend in a second direction towards the straight bars. The first direction is opposite the second direction.

After arranging the table into the compact state, the table is inserted into a packing box for storage and shipment. The packing box has an inner width no greater than the width "A" of the flat pack table components. A packed area within the packing box is over ninety percent of the total packing area of the packing box. In another example, the packed area is over ninety-five percent of the total packing area. Compact packing of the table provides for optimal storing, shipping, and transporting of the table.

After removing the flat pack table from the packing box, the table is assemblable into an end table. In one example, screws are provided along with the flat pack table to attach the components together. The flat pack table is assembled by attaching the straight bars between lower portions of the U-shaped bars. The straight bars provide support at a base of the table providing stability. The table top is attached between upper portions of the U-shaped bars. Each corner of the table attaches to an end of a U-shaped bar. In one example, the assembled flat pack table is an end table. In another example, the assembled flat pack table is a coffee table.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

Reference will now be made in detail to some embodiments of the invention, examples of which are illustrated in the accompanying drawings.

DETAILED DESCRIPTION

Figure 1:
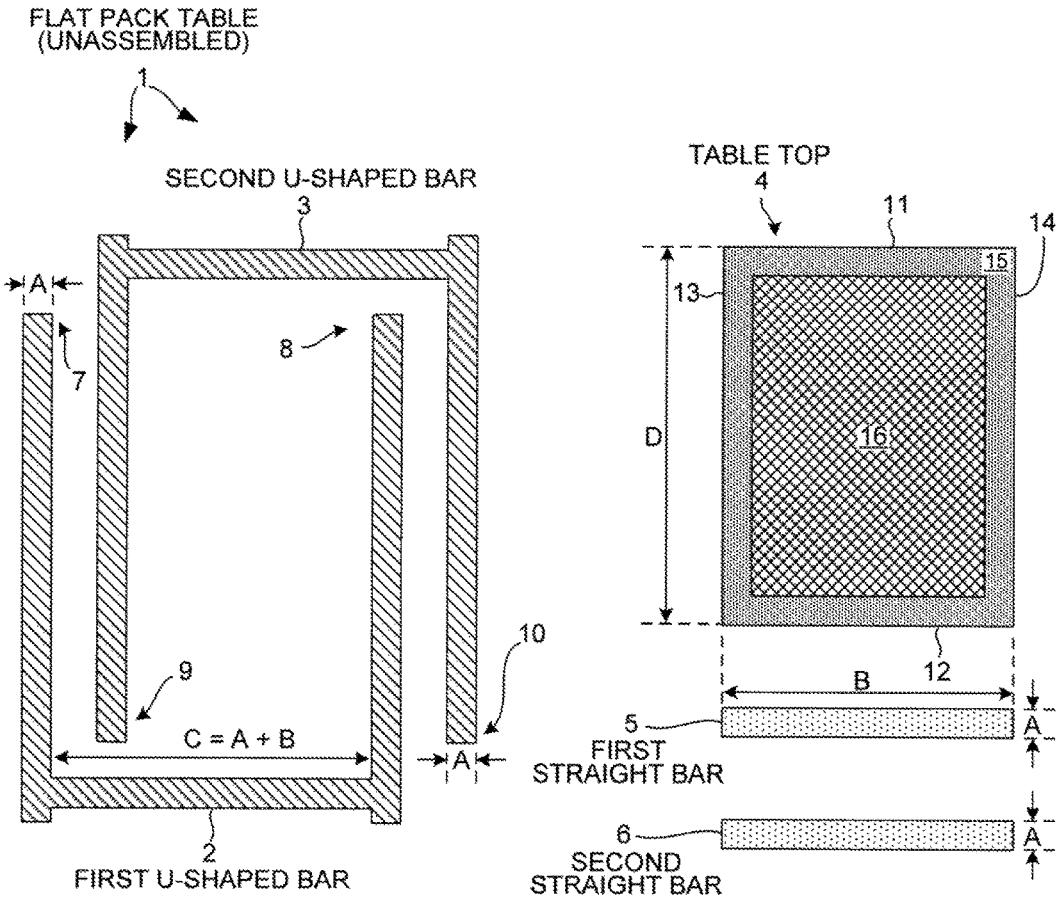
FIG. 1 is a diagram of a top view of a flat pack table that is unassembled.

FIG. 1 is a diagram of a top view of a flat pack table 1 that is unassembled. The flat pack table 1 comprises a first U-shaped bar 2, a second U-shaped bar 3, a table top 4, a first straight bar 5, and a second straight bar 6. The flat pack table 1 shown in FIG. 1 is unassembled to illustrate particular dimensions that provide for compact packing of the flat pack table 1.

In accordance with one novel aspect, components of the flat pack table 1 have dimensions "A", "B", "C", and "D" for arranging components of flat pack table 1 into a compact state. The compact state provides for optimal packing, storing, and shipping of the compact table 1. The relationship between dimensions "A", "B", "C", and "D" are explained below.

The first straight bar 5 and the second straight bar 6 are lateral support structures that attach between the U-shaped bars 2 and 3. The first straight bar 5 and the second straight bar 6 have substantially identical dimensions. The first straight bar 5 has a width "A" and a length "B". The second straight bar 6 has the width "A" and the length "B". Each of the straight bars 5 and 6 has a square cross section where each side of the square cross section has a length equal to the width "A". In embodiments of the table 1 in which the bars are tubes with circular cross sections, the tubes have a diameter of "A".

The first U-shaped bar 2 and the second U-shaped bar 2 are leg supports of the flat pack table 1. The first U-shaped bar 2 and the second U-shaped bar 2 have substantially identical dimensions. The first U-shaped bar 2 has the width "A". The first U-shaped bar 2 has a first end 7 and a second end 8. The first U-shaped bar 2 has a distance "C" between the first end 7 and the second end 8 of the first U-shaped bar 2. The distance "C" is substantially equal to width "A" plus length "B". The second U-shaped bar 3 has the width "A". The second U-shaped bar 3 has a first end 9 and a second end 10. The second U-shaped bar 3 has the distance "C" between the first end 9 and the second end 10 of the second U-shaped bar 3.

The table top 4 has a rectangular shape. The table top 4 has shorter sides 11 and 12 and longer sides 13 and 14. Each of the shorter sides 11 and 12 has the length "B". Each of the longer sides 13 and 14 has the length "D". The length "D" equals distance "C" plus two times the width "A". Table top 4 has a peripheral outer portion 15 that surrounds an inner portion 16. The outer portion 15 has a square cross section where each side of the square cross section has a length equal to width "A".

In this example, peripheral outer portion 15 is constructed of a first type of material and the inner portion 16 is constructed of a second type of material. The U-shaped bars 2 and 3 and the straight bars 5 and 6 are also constructed from the first type of material. The first type of material is different than the second type of material. For example, the first type of material is metal and the second type of material is wood. The second type of material can also be plastic molded to look like wood.

Flat pack table 1 is assemblable into an assembled state. In one example, flat pack table 1 is a standing end table in the assembled state. When the flat pack table 1 is in the assembled state, the straight bars 5-6 are connected between the first U-shaped bar 2 and the second U-shaped bar 3. In the assembled state, the ends 7-8 of the first U-shaped bar 2 are connected to opposite ends of one of the longer sides 13-14 of the rectangular table top 4, and the ends 9-10 of the second U-shaped bar 3 are connected to opposite ends of the other of the longer sides 13-14 of the rectangular table top 4. For example, ends 7-8 of the first U-shaped bar 2 are connected to side 13, and ends 9-10 of the second U-shaped bar 3 are connected to side 14.

Flat pack table 1 is assemblable into a compact state providing for optimal packing, storing, and shipping. When in the compact state, the table top 4 is disposed between the ends 7-8 of the first U-shaped bar 2, and one of the ends 9-10 of the second U-shaped bar 3 is disposed between the table top 4 and one of the ends 7-8 of the first U-shaped bar 2. In the compact state, the ends 7-8 of the first U-shaped bar 2 and the ends 9-10 of the second U-shaped bar 3 extend in opposite directions. The ends 7-8 of the first U-shaped bar 2 extend away from straight bars 5-6, and the ends 9-10 of the second U-shaped bar 3 extend toward straight bars 5-6.

Figure 2:
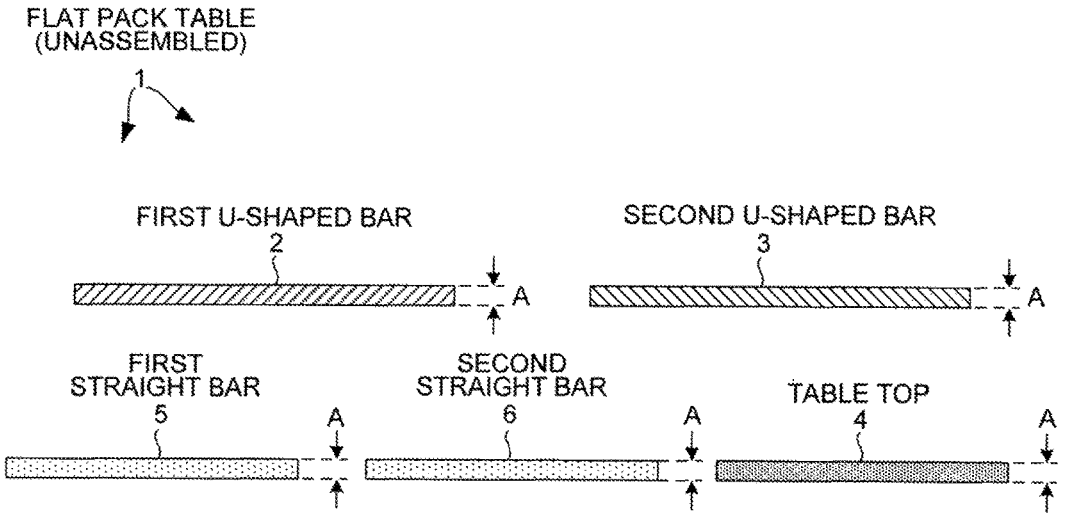
FIG. 2 is a diagram of a side view of the flat pack table in the unassembled state.

FIG. 2 is a diagram of a side view of the flat pack table 1 in the unassembled state. Each of the U-shaped bars 2-3, straight bars 5-6, and the table top 4 is of substantially the same width "A". Because each part of flat pack table 1 has the identical width "A", in the compact state the flat pack table 1 fits into a flat box having an inner width of "A". This minimal width "A" allows a manufacturer to transport more flat pack tables per container and allows a warehouse to store more flat pack tables than if the flat pack tables had a greater width.

Figure 3:
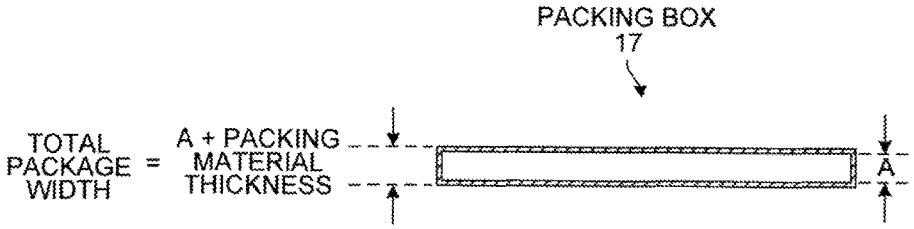
FIG. 3 is a diagram of a cross sectional view of a packing box.

FIG. 3 is a diagram of a cross sectional view of a packing box 17. When the flat pack table 1 is in the compact state, flat pack table 1 fits within the packing box 17. The packing box 17 has an inner width "A". The total width of packing box 17 is equal to the width "A" plus a thickness of the packaging material of packing box 17. The inside length of packing box 17 is no greater than the length "B" of the table top 4 plus four times the width "A" of the straight bars 5-6.

Figure 4:
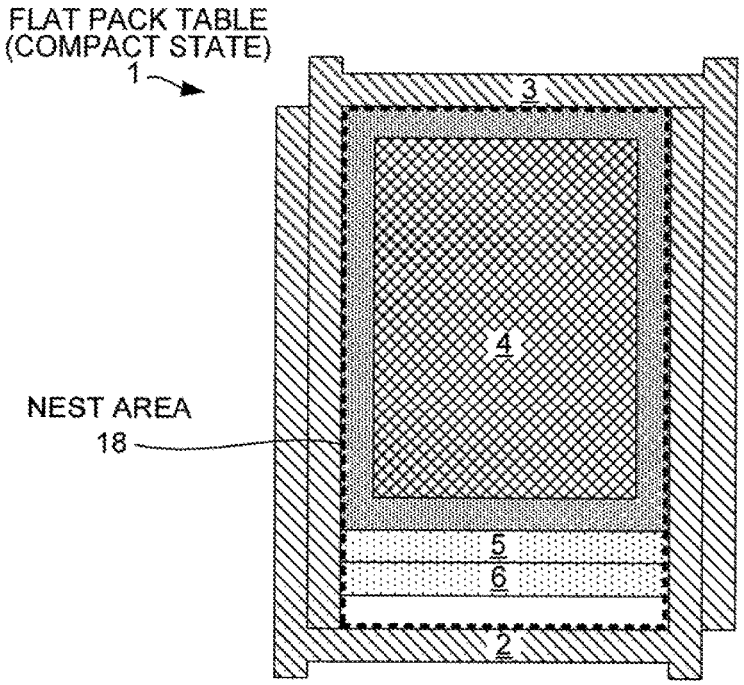
FIG. 4 is a diagram of a top view of flat pack table in a compact state.

FIG. 4 is a diagram of a top view of flat pack table 1 in a compact state. The second U-shaped bar 3 is adapted to nest with the first U-shaped bar 2. Nesting of U-shaped bars 3 and 2 forms an inner portion 18 referred to as a nest area. In the nested orientation, at least two surfaces of the first U-shaped bar 2 are adjacent to another surface of the second U-shaped bar 3.

Figure 5:
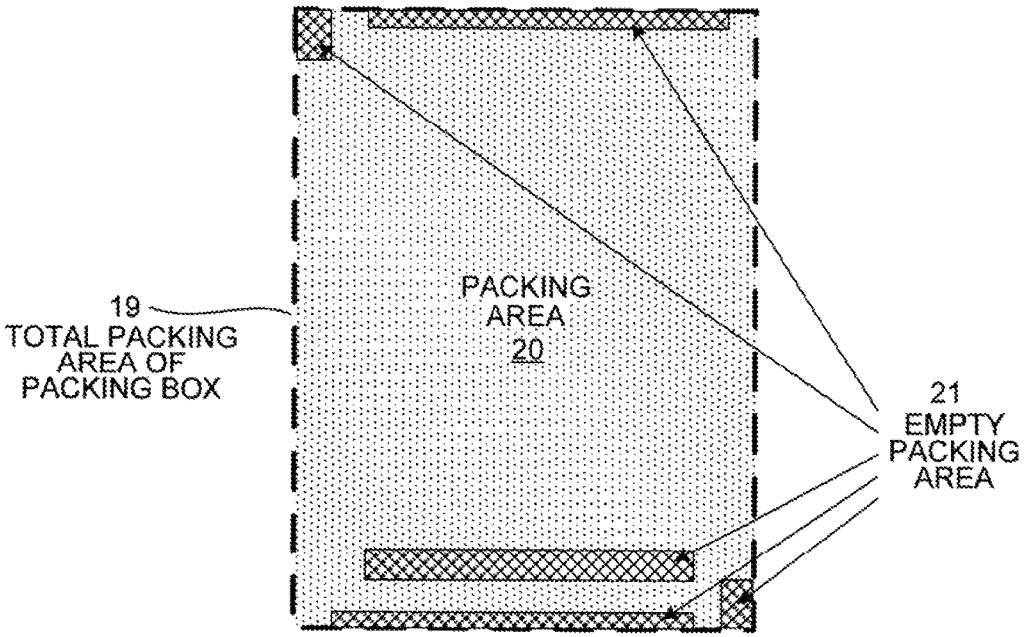
FIG. 5 is a top view showing how tightly the flat pack table is packed within a packing box.

FIG. 5 is a top view showing how tightly the flat pack table 1 is packed within packing box 17. The packing box 17 has a total packing area 19. When the flat pack table 1 is within packing box 17, the flat pack table 1 covers packing area 20 and leaves an empty packing area 21. Attachment mechanisms, including screws, bolts, nuts, and instructions are packed within the empty packing area 21. Packing area 20 is over ninety percent of the total packing area 19 of the packing box 17. In another example, packing area 20 is over ninety-five percent of the total packing area 19 of the packing box 17.

Figure 6:
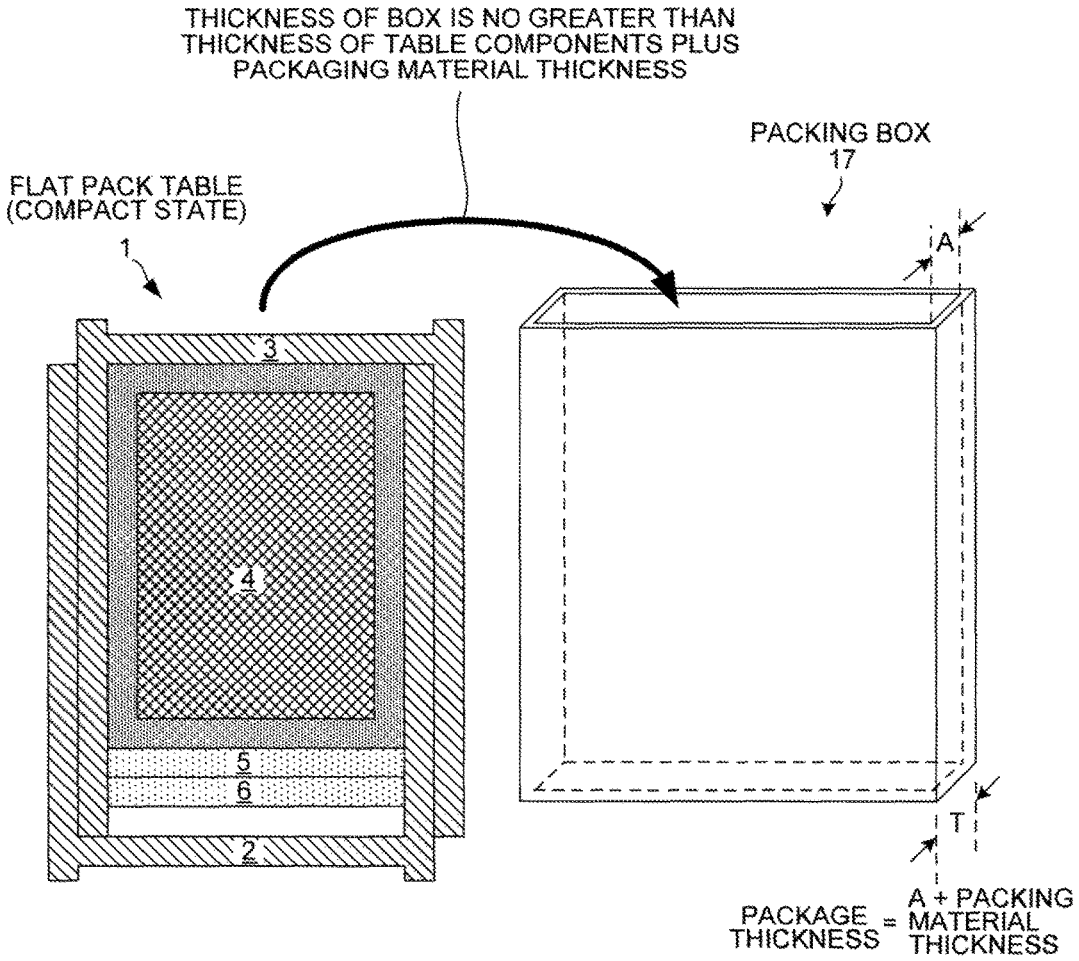
FIG. 6 is a perspective diagram showing how the compactly packed components of the flat pack table fit inside the packing box.

FIG. 6 is a perspective diagram showing how the compactly packed components of the flat pack table 1 fit inside the packing box 17. The total thickness T of packing box 17 is no greater than the thickness of the table components, equal to width "A", plus the packaging material thickness of packing box 17.

Figure 7:
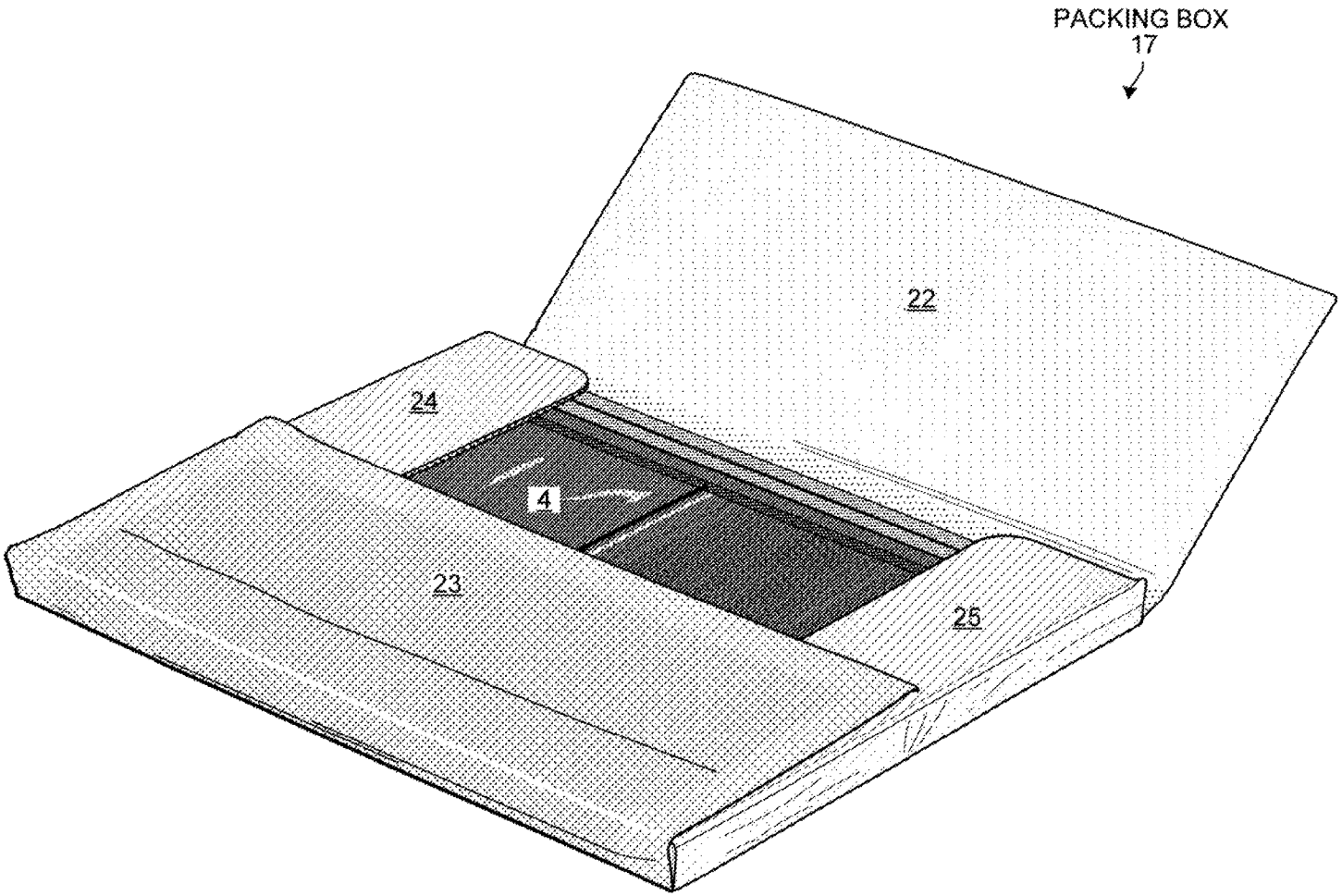
FIG. 7 is a perspective diagram showing how the flat pack table is removed from the packing box.

FIG. 7 is a perspective diagram showing how flat pack table 1 is removed from packing box 17. Packing box 17 has a first flap 22, a second flap 23, a third flap 24, and a fourth flap 25. Flat pack table 1 is removed by unattaching flaps 22 and 23, and opening flaps 22, 23, 24, and 25. FIG. 7 illustrates that packing box 17 has a total thickness equal to the width "A" of a table bar plus the combined thickness of the cardboard bottom of the box, the inside cardboard flap 25 and the outside cardboard flap 22.

Figure 8:
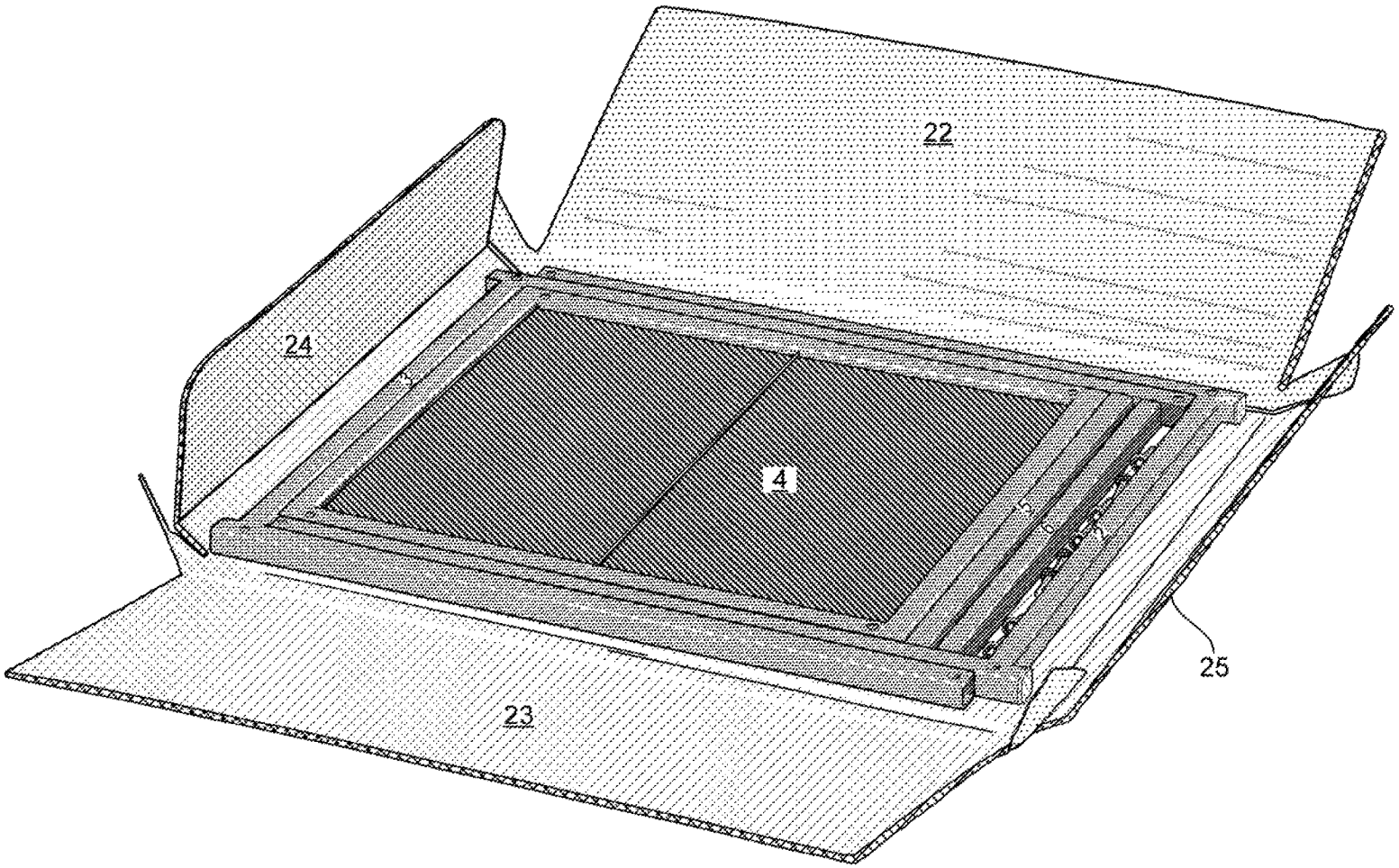
FIG. 8 is a perspective diagram showing how the packing box is opened.

FIG. 8 is a perspective diagram showing how packing box 17 is opened. After opening flaps 22, 23, 24, and 25, flat pack table 1 is removed from packing box 17. FIG. 8 shows that the attachment mechanisms, such as bolts 26, have been placed in the empty packing area 21 for shipping.

Figure 9:
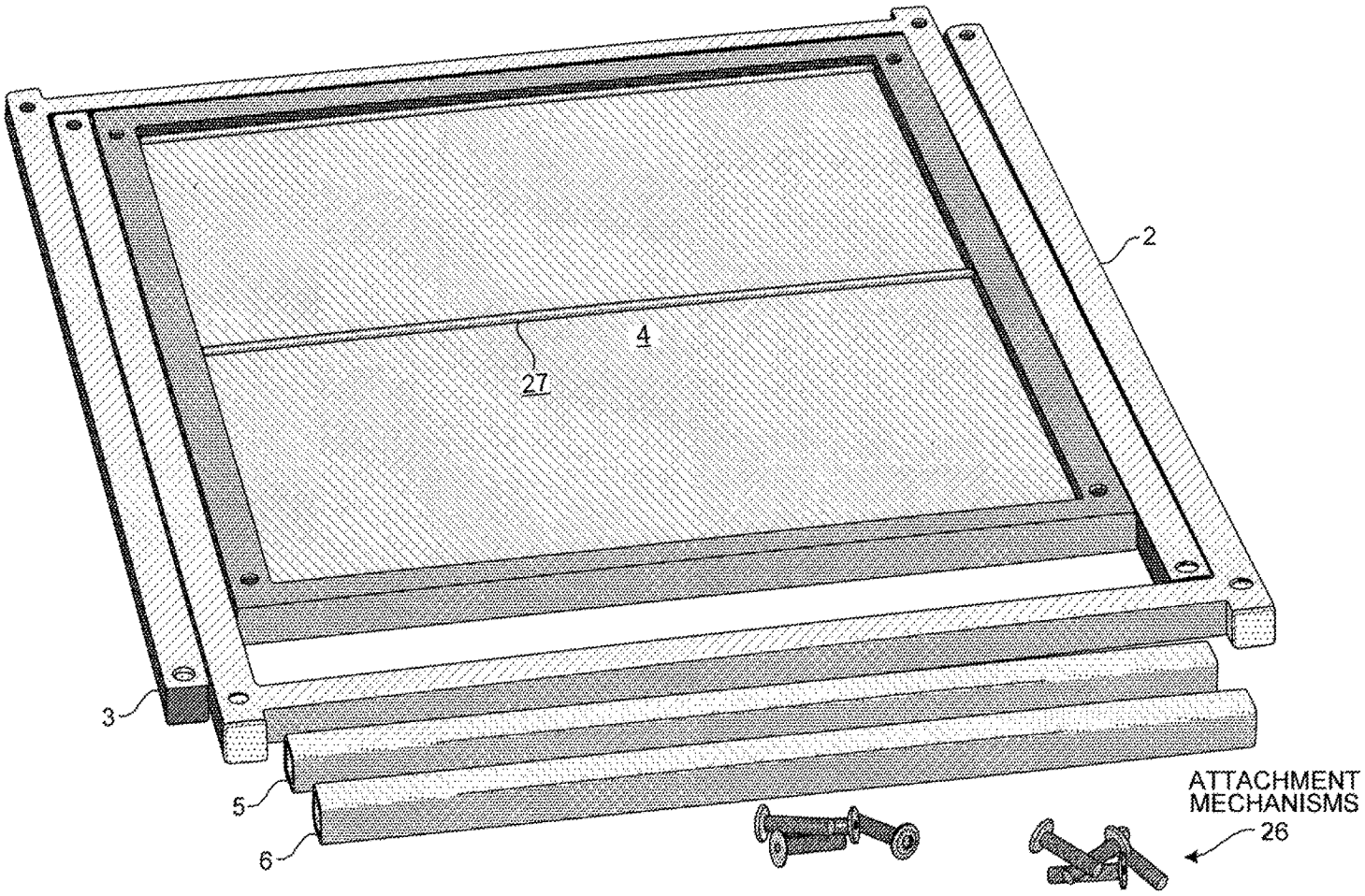
FIG. 9 is a perspective diagram of the flat pack table in its compact state.

FIG. 9 is a perspective diagram of the flat pack table 1 in its compact state. The attachment mechanisms 26 are provided to assemble the flat pack table 1. In this example, each attachment mechanism 26 is a metal bolt that passes through two holes in a first bar and is tightened into a threaded hole in a second bar to which the first bar is attached. A thin support bar 27 extends from opposite sides of the frame through the center of table top 4. Support bar 27 provides structural support along the center of the table top 4. Two other support bars extend between the opposite sides of the frame on either side of support bar 27.

Figure 10:
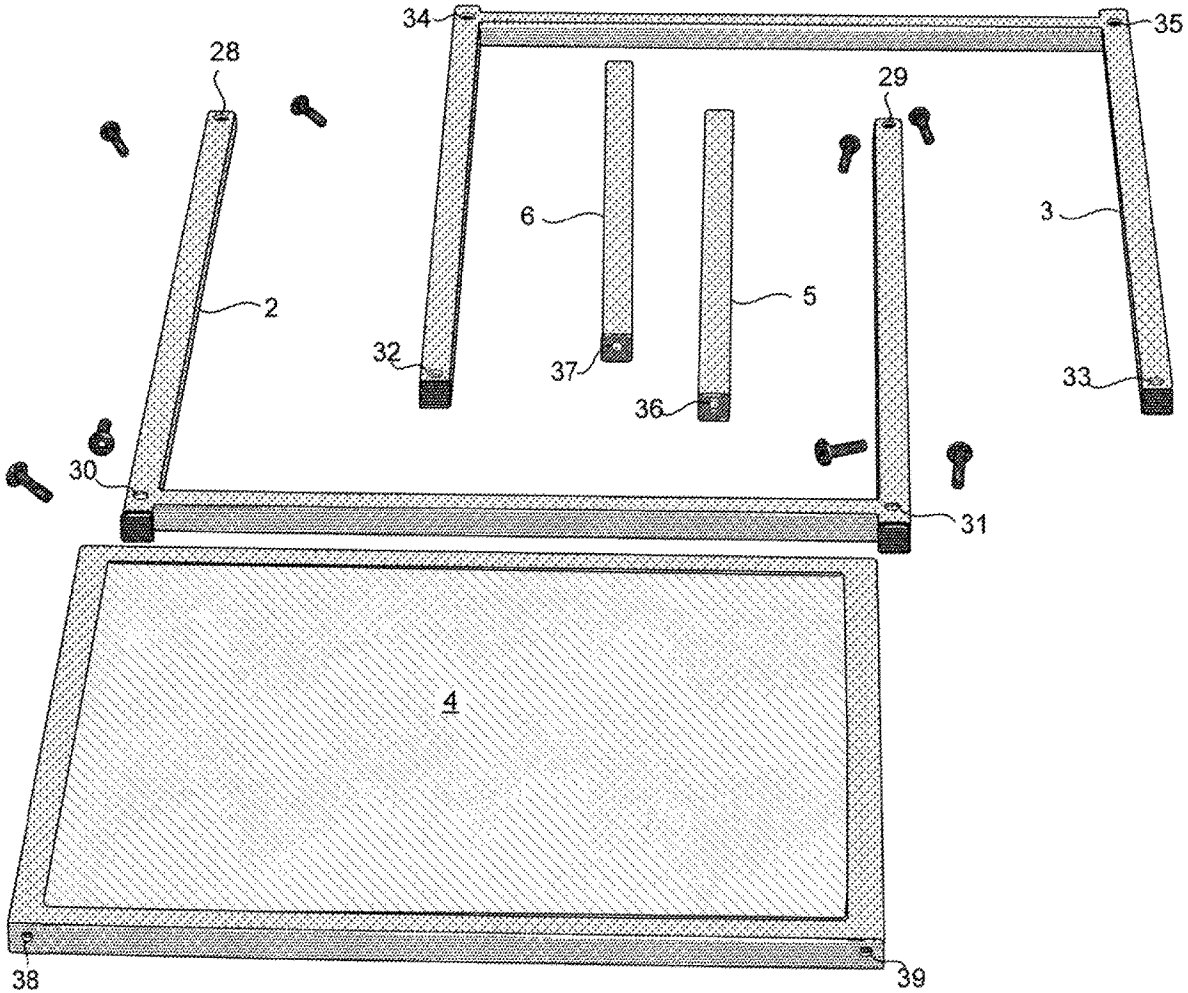
FIG. 10 is a perspective diagram of the flat pack table showing the various components of the table.

FIG. 10 is a perspective diagram of the flat pack table 1 showing the various components of the table 1. Each of the U-shaped bars 2-3 has four openings for fastening to respective openings of the table top 4 and straight bars 5-6. The first U-shaped bar 2 has openings 28, 29, 30, and 31. Openings 28-29 are disposed at an upper portion of the first U-shaped bar 2 and are adapted to attach to corners of table top 4. Openings 30-31 are disposed at a lower portion of the first U-shaped bar 2 and are adapted to attach to ends of straight bars 5-6.

The second U-shaped bar 3 has openings 32, 33, 34, and 35. Openings 32-33 are disposed at an upper portion of the second U-shaped bar 3 and are adapted to attach to corners of table top 4. Openings 34-35 are disposed at a lower portion of the second U-shaped bar 3 and are adapted to attach to ends of straight bars 5-6.

Each of the straight bars 5-6 has openings disposed at the ends of the bars. Reference numeral 36 identifies one such opening disposed at an end of straight bar 5. Reference numeral 37 identifies another such opening disposed at an end of straight bar 6. The openings disposed at the opposite ends of the bars are hidden from the view depicted in FIG. 10.

The table top 4 has four openings. The bolts 26 pass through the openings in the bars and the table top. Each opening of table top 4 is disposed near a corner of the table top 4. The openings of table top 4 are adapted to attach to ends of the U-shaped bars 2 and 3 to secure the table top 4 to the U-shaped bars 2 and 3. Reference numeral 38 identifies one opening, and reference numeral 39 identifies another such opening. The other two openings are hidden from the view depicted in FIG. 10.

Figure 11:
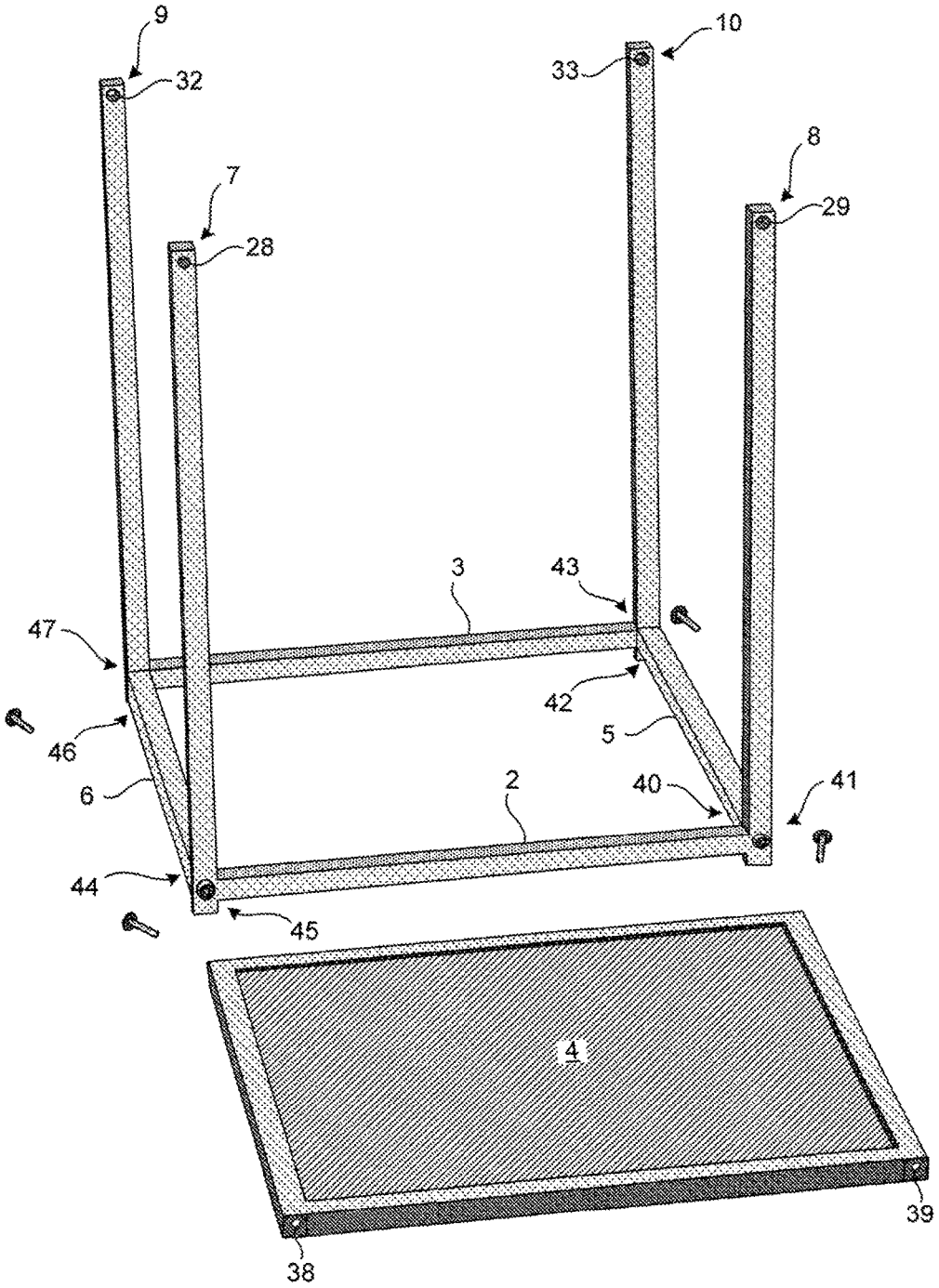
FIG. 11 is a perspective diagram of the flat pack table showing how straight bars connect between U-shaped bars.

FIG. 11 is a perspective diagram of the flat pack table 1 showing how the straight bars 5 and 6 connect between the U-shaped bars 2 and 3. The straight bars 5 and 6 attach the U-shaped bars 2 and 3 together, thereby offering structural support at the base of the table 1 and rendering the table more stable and sturdy.

First straight bar 5 connects between first U-shaped bar 2 and second U-shaped bar 3. One of the bolts 26 is used to attach a first end 40 of first straight bar 5 to a first corner 41 of first U-shaped bar 2. The bolt 26 passes through two holes in U-shaped bar 2 and is then tightened into a threaded hole at the end of first straight bar 5. Another of the bolts 26 attaches a second end 42 of first straight bar 5 to a first corner 43 of second U-shaped bar 3.

Second straight bar 6 connects between first U-shaped bar 2 and second U-shaped bar 3. One of the bolts 26 is used to attach a first end 44 of second straight bar 6 to a second corner 45 of first U-shaped bar 2. Another of the bolts 26 is used to attach a second end 46 of second straight bar 6 to a second corner 47 of second U-shaped bar 3. After attaching the straight bars 5 and 6 between U-shaped bars 2 and 3, the table top 4 is attached between ends 7 and 8 of first U-shaped bar 2 and between ends 9 and 10 of second U-shaped bar 3.

Figure 12:
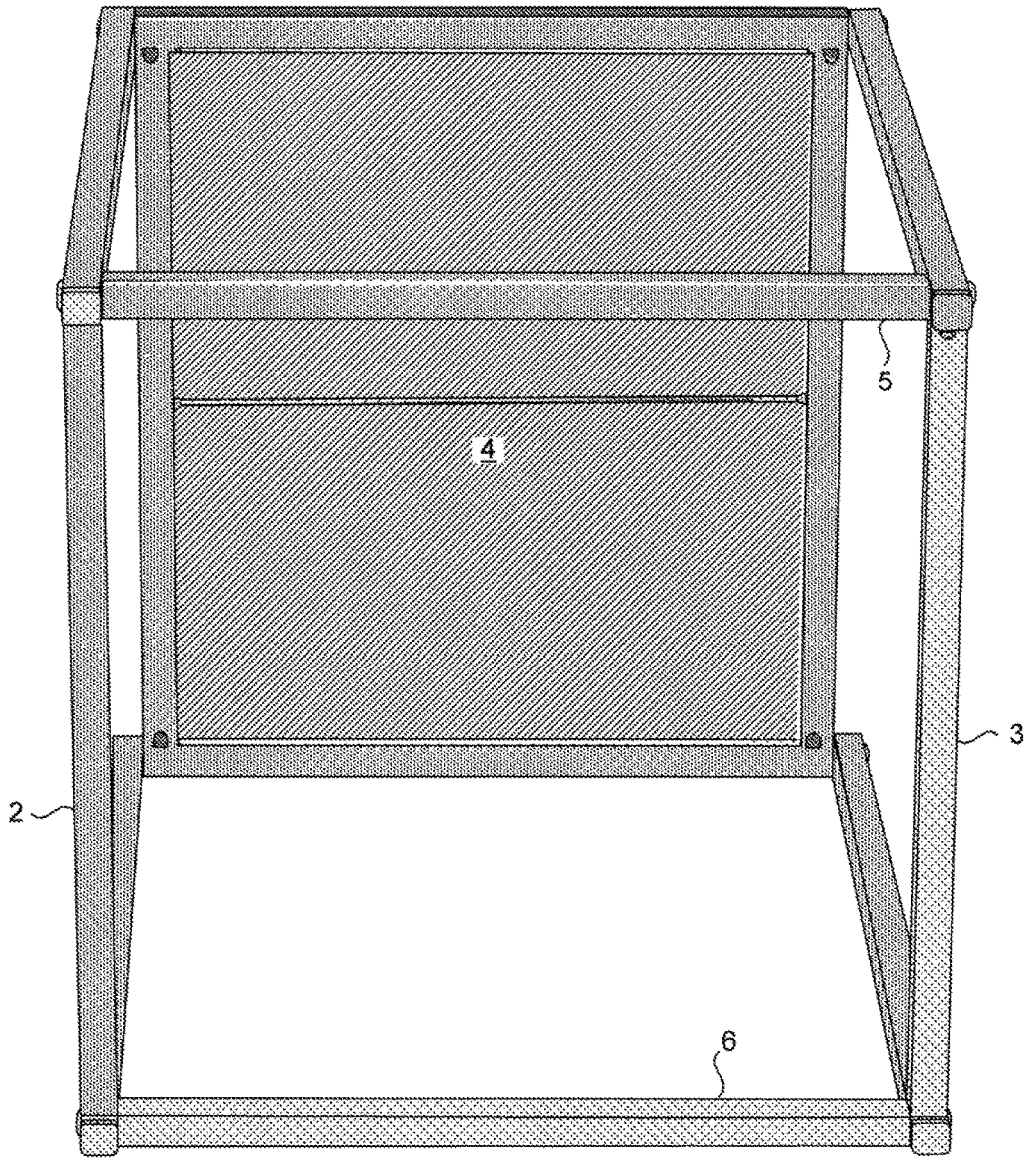
FIG. 12 is a perspective view showing how the table top attaches to the first U-shaped bar and the second U-shaped bar.

FIG. 12 is a perspective view showing how the table top 4 attaches to first U-shaped bar 2 and second U-shaped bar 3. The table top 4 connects between the ends 7 and 8 of first U-shaped bar 2 and between the ends 9 and 10 of second U-shaped bar 3. Bolts are used to attach the corners of the table top to the ends of the U-shaped bars 2 and 3.

Figure 13:
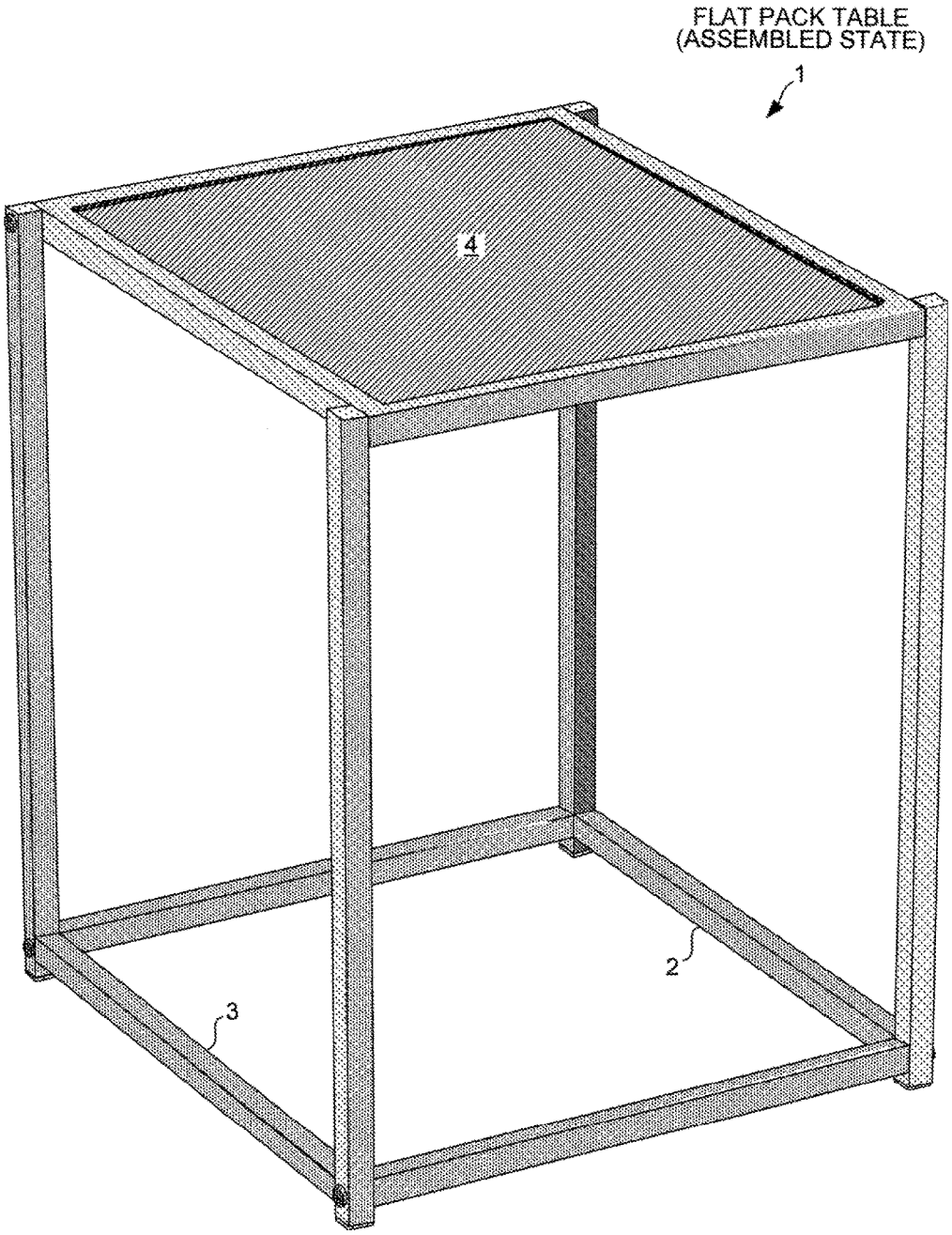
FIG. 13 is a perspective diagram of the flat pack table in an assembled state.

FIG. 13 is a perspective diagram of flat pack table 1 in an assembled state. In the example of FIG. 13, the assembled flat pack table 1 is usable as an end table.

Figure 14:
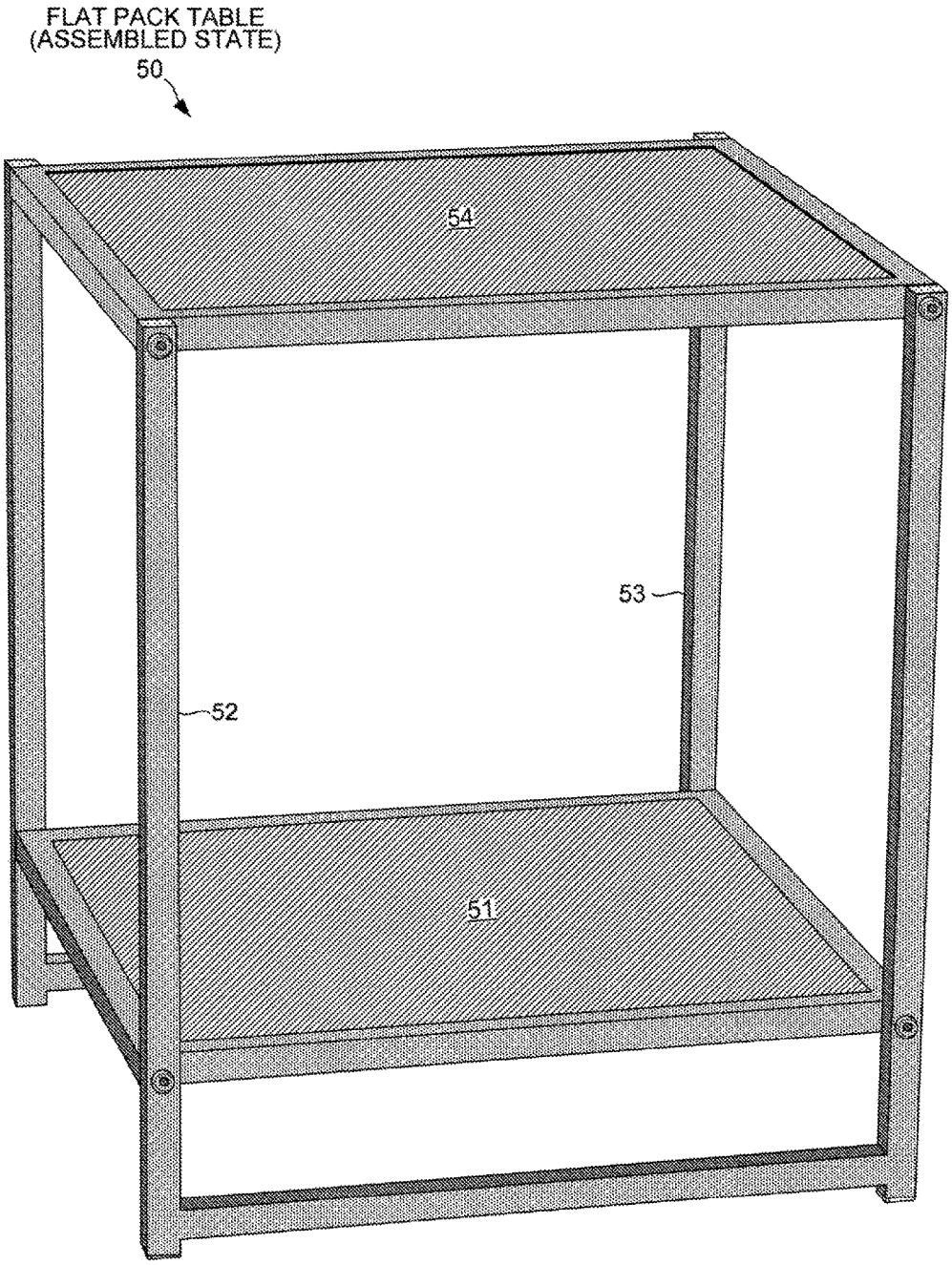
FIG. 14 is a perspective diagram of a second embodiment of a flat pack table having a shelf.

FIG. 14 is a perspective diagram of a second embodiment of a flat pack table 50 having a shelf 51. The flat pack table 50 does not have straight bars. Shelf 51 attaches between ends of the U-shaped bars 52 and 53. The shelf 51 is disposed below the table top 54. The shelf 51 provides sufficient structural support at a base of table 50 so that the straight bars of table 1 are not needed. The embodiment of FIG. 14 can be used as a book shelf, especially when a second shelf is added.

Figure 15:
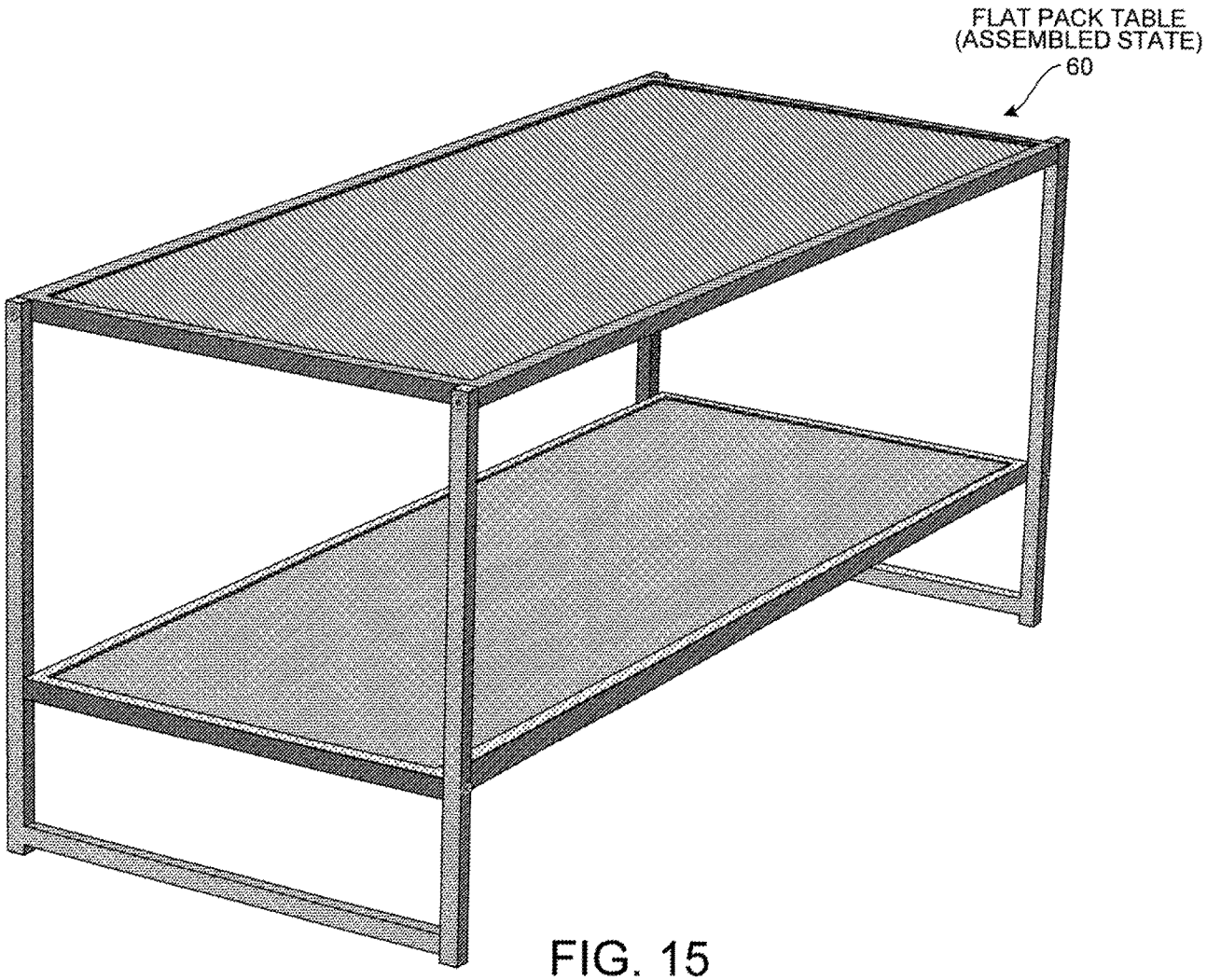
FIG. 15 is a diagram of a third embodiment of a flat pack table; in an assembled state, the flat pack table is a coffee table.

FIG. 15 is a diagram of a third embodiment of a flat pack table 50. In an assembled state, the flat pack table 50 is a coffee table.

Figure 16:
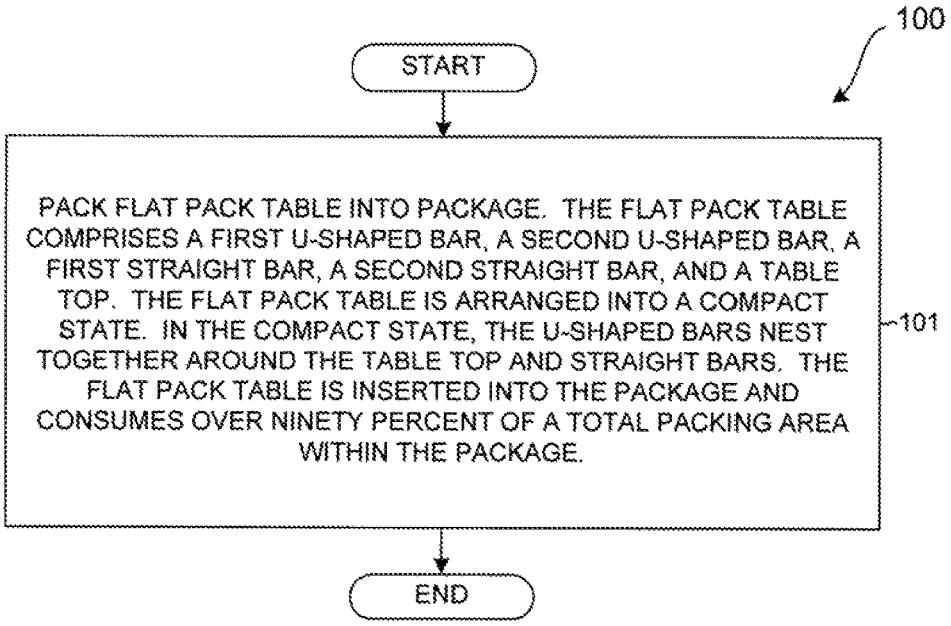
FIG. 16 is a flowchart of a method in accordance with a first novel aspect.

FIG. 16 is a flowchart of a method 100 in accordance with a first novel aspect. In a first step, (step 101) a flat pack table is packed into a package, such as a cardboard box. The flat pack table comprises a first U-shaped bar, a second U-shaped bar, a first straight bar, a second straight bar, and a table top. The flat pack table is arranged into the compact state. In the compact state, the U-shaped bars nest together around the table top and straight bars. The flat pack table is inserted into the box and consumes over ninety percent of a total packing area within the package. For example, in FIG. 6, flat pack table 1 is arranged into a compact state. In the compact state, the flat pack table 1 has a width of "A". The flat pack table is inserted into packing box 17.

Figure 17:
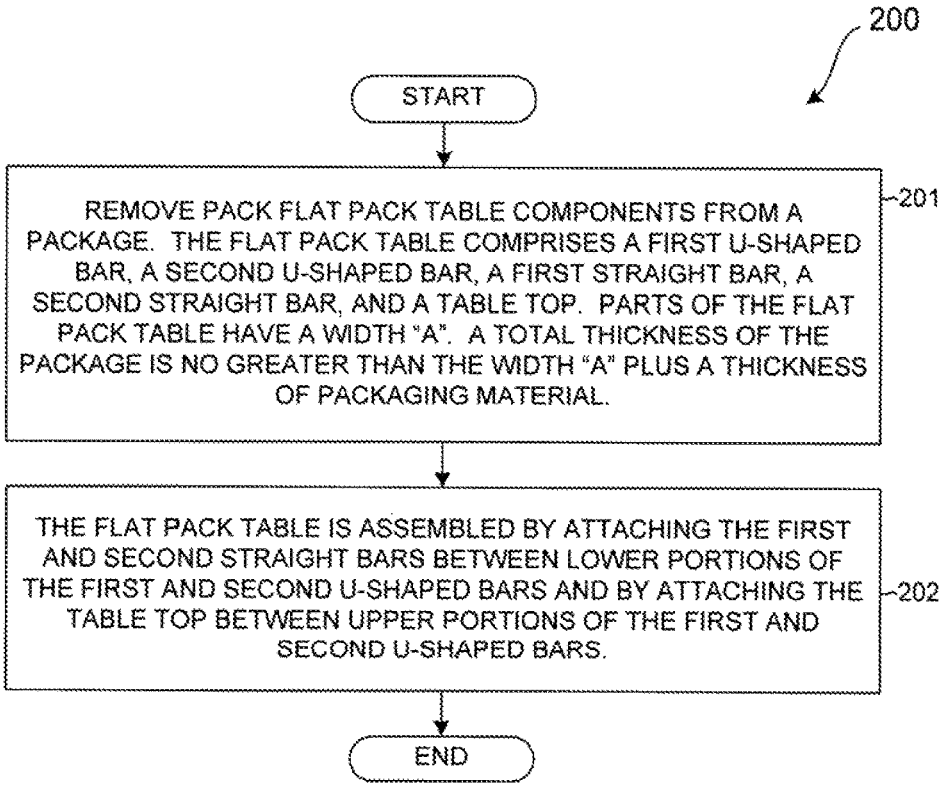
FIG. 17 is a flowchart of a method in accordance with a second novel aspect.

FIG. 17 is a flowchart of a method 200 in accordance with a second novel aspect. In a first step (step 201), a flat pack table is removed from the packaging, such as a cardboard box. The flat pack table comprises a first U-shaped bar, a second U-shaped bar, a first straight bar, a second straight bar, and a table top. Parts of the flat pack table have a width "A". A total thickness of the box is no greater than the width "A" plus the thickness of packaging material. For example, in FIGS. 7-8, packing box 17 is opened by opening flaps 22, 23, 24, and 25, and parts of flat pack table 1 are removed as shown in FIGS. 9-10.

In a second step (step 202), the flat pack table is assembled by attaching the first and second straight bars between lower portions of the first and second U-shaped bars and by attaching the table top between upper portions of the first and second U-shaped bars. For example, in FIG. 11, first straight bar 5 is attached between first U-shaped bar 2 and second U-shaped bar 3 and second straight bar 6 is attached between first U-shaped bar 2 and second U-shaped bar 3 using screws. In FIG. 12, the table top 4 is attached between ends 7 and 8 of first U-shaped bar 2 and between ends 9 and 10 of second U-shaped bar 3 using screws. The assembled flat pack table 1 is shown in FIG. 13.

By manufacturing the flat pack table 1 so that it can fit compactly within a flat box, the flat pack table is better suited to sell in mass-market retail stores and can more easily be transported from the store to the location where the table will be set. The larger dimensions of a conventional table take up valuable floor space in mass-market stores. More flat pack tables than conventionally packaged tables can be stacked in the same area on a store shelf. Thus, less floor space is needed to store and display flat pack table 1 on store shelves. The large size of conventionally packaged table also makes it impractical for a consumer to transport the table home from a mass-market retail store. The slim flat pack packing box 17 containing the flat pack table 1 in a compact state, however, can easily be brought from the store shelf to the check-out counter and then to the trunk of the consumer's car. The packing box 17 containing flat pack table 1 can more easily be held and maneuvered up stairs, into apartment elevators and around corners than would a conventional table.

Although certain specific embodiments are described above for instructional purposes, the teachings of this patent document have general applicability and are not limited to the specific embodiments described above. For example, although flat pack table 1 is shown to have a rectangular shape, the flat pack table 1 can be constructed to have a square shape where side lengths of each side of the table top are equivalent. Accordingly, various modifications, adaptations, and combinations of various features of the described embodiments can be practiced without departing from the scope of the invention as set forth in the claims.

What is claimed is:

1. A table comprising:

a first straight bar, wherein the first straight bar has a width A and a length B;

a second straight bar having the width A and the length B;

a first U-shaped bar having the width A and a distance C between ends of the first U-shaped bar, and wherein C equals A plus B;

a second U-shaped bar having the width A and the distance C between ends of the second U-shaped bar; and a rectangular table top having shorter sides each with the length B and longer sides each with a length D, wherein D equals C plus two times A, wherein in an assembled state the ends of the first U-shaped bar are connected to opposite ends of one of the longer sides of the rectangular table top, and the ends of the second U-shaped bar are connected to opposite ends of the other of the longer sides of the rectangular table top, wherein in a compact state the rectangular table top is disposed between the ends of the first U-shaped bar, and one of the ends of the second U-shaped bar is disposed between the rectangular table top and one of the ends of the first U-shaped bar, and wherein the ends of the first U-shaped bar and the ends of the second U-shaped bar extend in opposite directions.

2. The table of claim 1, further comprising:

a packing box, wherein the table is disposed inside the packing box in the compact state, wherein the packing box has an inside width that is no greater than the length B of the rectangular table top plus four times the width A of the first straight bar, and wherein the packing box has an inside height that is no greater than the width A of the first straight bar.

3. The table of claim 1, wherein the first straight bar has a square cross section, and wherein each side of the square cross section has a length A.

4. The table of claim 1, wherein the first straight bar has a circular cross section, and wherein the cross section has a diameter with a length A.

5. The table of claim 1, wherein in the assembled state the first straight bar is connected between the first U-shaped bar and the second U-shaped bar.

6. The table of claim 1, wherein in the compact state the first straight bar is disposed between one of the shorter sides of the rectangular table top and a bottom portion of the first U-shaped bar.

7. The table of claim 1, wherein the rectangular table top is made of a first material surrounded on both shorter sides and both longer sides by a metal bar, wherein the metal bar has a square cross section, and wherein each side of the square cross section has a length A.

8. The table of claim 1, wherein the first straight bar and the second straight bar form opposite shorter sides of a rectangular shelf, and wherein the rectangular shelf has longer sides each having the length D.

9. A flat pack table comprising:

a first U-shaped bar;

a second U-shaped bar, wherein the second U-shaped bar is adapted to nest with the first U-shaped bar to form a nest area, wherein at least two surfaces of the first U-shaped bar are adjacent to another surface of the second U-shaped bar;

a base, wherein the base fits within the nest area, wherein two surfaces of the base are adjacent to one of the first and second U-shaped bars, and wherein another one of the surfaces of the base is adjacent to the other of the first and second U-shaped bars;

a first support bar, wherein the first support bar fits within the nest area; and a second support bar, wherein the second support bar fits within the nest area.

10. The flat pack table of claim 9, wherein one of the first and second support bars are adjacent to a surface of the base.

11. A table adapted to be packaged into a packing box comprising:

a table top; and means for supporting the table top at least one foot above a ground plane, wherein the means surrounds the table top, and wherein the table top and the means consume at least ninety percent of a packing surface area within the packing box.

12. The table of claim 11, wherein the means is a first U-shaped bar and a second U-shaped bar, wherein the first and second U-shaped bars nest around the table top when the table and the U-shaped bars are disposed within the packing box.

* * * * *